US010519673B2

(12) United States Patent
Joshi et al.

(10) Patent No.: US 10,519,673 B2
(45) Date of Patent: Dec. 31, 2019

(54) BUILDING CLADDING AND METHOD FOR PREPARING SAME

(71) Applicant: James Hardie Technology Limited, Dublin (IE)

(72) Inventors: Amol Joshi, Chino Hills, CA (US); Brian McQuerrey, Rancho Cucamonga, CA (US); Hui Li, Fontana, CA (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 15/773,059

(22) PCT Filed: Dec. 22, 2016

(86) PCT No.: PCT/EP2016/082499

§ 371 (c)(1),
(2) Date: May 2, 2018

(87) PCT Pub. No.: WO2017/109142

PCT Pub. Date: Jun. 29, 2017

(65) Prior Publication Data

US 2018/0328044 A1 Nov. 15, 2018

Related U.S. Application Data

(60) Provisional application No. 62/387,599, filed on Dec. 23, 2015.

(51) Int. Cl.

| | |
|---|---|
| ***E04B 1/70*** | (2006.01) |
| ***E04F 13/08*** | (2006.01) |
| ***E04F 13/00*** | (2006.01) |

(52) U.S. Cl.

CPC ..... *E04F 13/0869* (2013.01); *E04F 13/007* (2013.01); *E04F 2290/02* (2013.01)

(58) Field of Classification Search

CPC .. E04F 13/0869; E04F 13/007; E04F 2290/02

(Continued)

(56) References Cited

U.S. PATENT DOCUMENTS 3,318,056 A * 5/1967 Thompson ..... E04B 2/709 52/105
4,000,595 A * 1/1977 Fortescue ..... G21C 11/086 220/62.19

(Continued)

FOREIGN PATENT DOCUMENTS

WO WO 2017/109142 A1 6/2017

OTHER PUBLICATIONS

International Search Report and Written Opinion for corresponding PCT Application No. PCT/EP2016/082499 filed Dec. 22, 2016, dated Apr. 5, 2017, 13 pages.

*Primary Examiner* — Basil S Katcheves
(74) *Attorney, Agent, or Firm* — Knobbe, Martens, Olson & Bear, LLP

(57) ABSTRACT

A wall cladding panel comprising a substantially planar front face, a rear face comprising a plurality of drainage channels and a plurality of spacer sections disposed between the drainage channels, and an edge member disposed contiguously between the front face and the rear face. The wall cladding panel is locally thinner at the drainage channels than at the spacer sections. Each drainage channel is configured to form a liquid flow path and/or an air gap when a substantially planar building surface is placed adjacent to the rear face. A plurality of wall cladding panels with drainage channels may be arranged in series to cover at least a portion of a building.

23 Claims, 10 Drawing Sheets

(58) Field of Classification Search
USPC ..... 52/302.1
See application file for complete search history.

(56) References Cited

U.S. PATENT DOCUMENTS 5,953,883 A * 9/1999 Ojala ..... E04B 1/26 52/220.1
6,355,333 B1 * 3/2002 Waggoner ..... E04B 1/62 428/174
6,594,965 B2 * 7/2003 Coulton ..... E04B 1/7046 52/302.1
6,804,922 B1 * 10/2004 Egan ..... B32B 5/02 52/309.1
6,990,775 B2 * 1/2006 Koester ..... E04B 1/70 428/121
7,181,888 B1 * 2/2007 Facaros ..... E02D 31/02 52/169.5
7,472,523 B2 1/2009 Beck
7,617,638 B1 * 11/2009 Slama ..... E04B 2/707 52/198
8,534,018 B2 * 9/2013 Walker ..... E04C 2/34 428/105
8,555,581 B2 * 10/2013 Amend ..... E04F 13/0875 52/302.1
8,833,025 B2 * 9/2014 Krause ..... E04F 13/0828 52/506.08
9,140,064 B2 * 9/2015 Guthrie ..... E04C 2/525
9,394,696 B2 7/2016 Norwood et al.
9,963,887 B2 5/2018 Norwood et al.
2006/0053740 A1 * 3/2006 Wilson ..... E04F 13/0864 52/745.09
2008/0104918 A1 * 5/2008 Gleeson ..... E04B 1/74 52/489.1
2009/0282762 A1 * 11/2009 Iske ..... E21D 11/381 52/302.1
2010/0175809 A1 * 7/2010 Jeremiah ..... E04F 13/007 156/71
2010/0186305 A1 * 7/2010 Larimore ..... E04F 15/022 52/1
2010/0251632 A1 10/2010 Chen et al.
2010/0300026 A1 * 12/2010 Candiracci ..... E04B 2/845 52/309.4
2011/0197530 A1 * 8/2011 Bahnmiller ..... B32B 5/14 52/309.4
2012/0167505 A1 * 7/2012 Krause ..... E04F 13/0817 52/302.1
2012/0297697 A1 * 11/2012 Schaefer ..... E04C 2/30 52/58
2013/0125487 A1 * 5/2013 Power ..... E04B 1/70 52/302.3
2015/0096248 A1 * 4/2015 Tebo ..... E04D 13/17 52/302.3
2018/0251988 A1 9/2018 Norwood et al.
2019/0017279 A1 1/2019 Norwood et al.

* cited by examiner

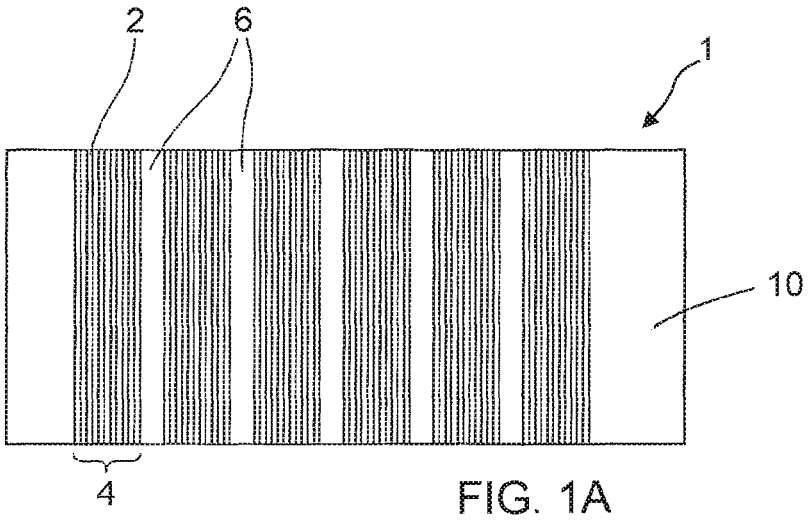
FIG. 1A
FIG. 1C
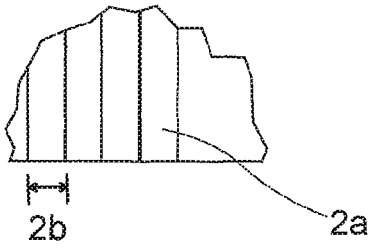
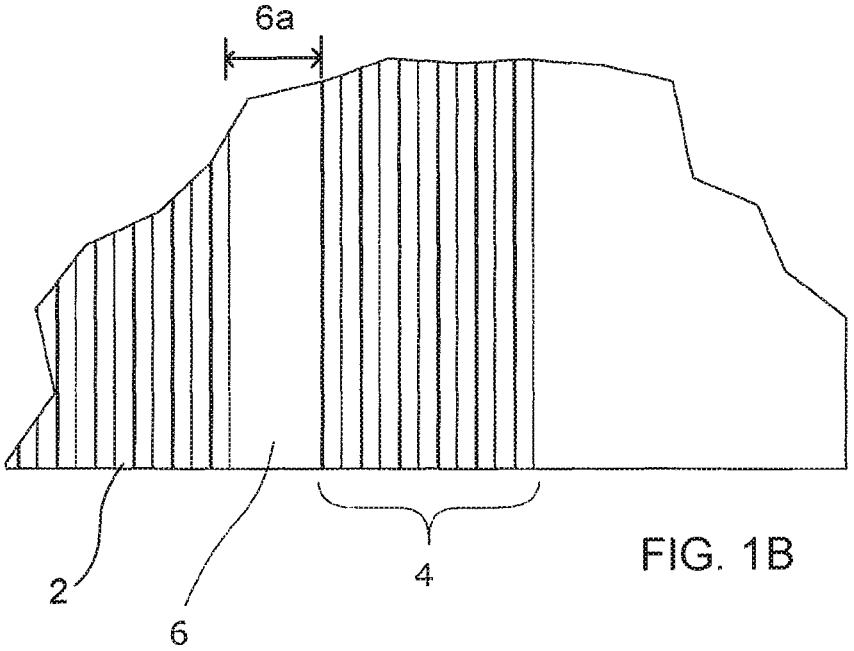
FIG. 1B

BUILDING CLADDING AND METHOD FOR PREPARING SAME

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present invention generally relates to a cementitious building article and methods for preparing same.

Description of the Related Art

Fibre cement articles are conventionally used as cladding materials to form the exterior and/or interior walls of a building by attaching the fibre cement article to a structural building frame.

A common building practice is to attach the fibre cement article to the structural building frame such that a rain screen system is formed whereby there is an air barrier between fibre cement article and the building frame. Usually, the building frame is enclosed by a weather resistant barrier in the form of a building or house wrap. The fibre cement article forms a first barrier to prevent the air and weather resistant barrier from getting wet whilst the second barrier or air gap between the fibre cement article and house wrap creates a capillary break which allows for drainage and evaporation. One method of creating the air gap is to employ the use of wood furring strips in the form of battens which are interspersed and secured vertically over the house wrap to the building frame. The fibre cement article is then secured to the furring strips. The furring strips function to set the fibre cement article apart from the building frame thereby establishing the air gap necessary to form the rain screen system.

The attachment of furring strips places an additional burden financially and in terms of complexity of installation. In addition to requiring the purchase of more materials for construction, installation of furring strips also requires special training and craftsmanship, such as for door and window area detail. In view of the foregoing, there is a need to provide a simplified system that has all of the advantages of the rain screen system, including high drainage efficiency, while reducing complexity of installation.

SUMMARY

Accordingly, there is provided in one embodiment a cementitious building article comprising a front face and a rear face and an edge member intermediate to and contiguous to the front face and the rear face, wherein a plurality of drainage channels are integrally formed on the rear face of the cementitious building article.

In a further embodiment, there is provided a building system, comprising;

a building substrate;

a cementitious building article comprising a front face, a rear face and an edge member intermediate to and contiguous to the front face and the rear face, the rear face of the cementitious building article comprising a plurality of drainage channels integrally formed therein, wherein the cementitious building article is securable to the building substrate; and a weather resistant barrier locatable intermediate the building substrate and the cementitious building article such that the integrally formed drainage channels are adjacent the weather resistant barrier.

In one embodiment the cementitious building article is suitable for use as a cladding panel.

In another embodiment, a building system is described, wherein the building system comprises;

a weather resistant barrier disposed external to a building substrate; and at least one wall cladding panel fixed to the weather resistant barrier and the building substrate such that the wall cladding panel is external to the weather resistant barrier, the at least one wall cladding panel comprising a substantially planar front face; a rear face comprising a plurality of substantially parallel drainage channels and a plurality of spacer sections disposed between the drainage channels; and an edge member disposed contiguously between the front face and the rear face.

In a further embodiment, the building system comprises a plurality of air gaps, each air gap being bounded by a portion of the weather resistant barrier and one of the drainage channels of the rear face. The configuration and arrangement of the air gaps along the wall cladding panel correspond to a preselected drainage efficiency wherein each air gap comprises a liquid flow path between the weather resistant barrier and the wall cladding panel. In one embodiment, the preselected drainage efficiency is greater than 90% when measured using ASTM E-2773.

It is to be understood that in certain embodiments, the configuration of each drainage channel, for example, the width and depth together with the frequency of drainage channels within the cementitious building article influences the configuration and arrangement of the air gaps along the wall cladding panel and consequently the drainage efficiency.

In another embodiment, a cementitious building article in the form of a wall cladding panel is described, wherein the wall cladding panel comprises a substantially planar front face, a rear face, and an edge member disposed contiguously between the front face and the rear face, the rear face comprises a plurality of substantially parallel drainage channels and a plurality of spacer sections disposed between the drainage channels, wherein the wall cladding panel has a first thickness at the spacer sections and wherein the thickness of the wall cladding panel at the drainage channels is smaller than the first thickness and wherein each drainage channel is configured to form a liquid flow path when a substantially planar building surface is placed adjacent to the rear face.

Conveniently, the cementitious building article or wall cladding panel is suitable for use in the building systems described herein.

In one embodiment, the configuration of the cementitious building article is such that the percentage of total surface area occupied by the plurality of drainage channels relative to the total surface area of the cementitious building article is between 18% and 75%±0.5%. In other embodiments, the percentage of total surface area occupied by the plurality of drainage channels relative to the total surface area of the cementitious building article may be between 18% and 50%±0.5%. In a further embodiment, the frequency of drainage channels in the plurality of drainage channels is between 8 and 16 drainage channels per lineal foot of the cementitious building article along a direction perpendicular to the orientation of the plurality of drainage channels. In some embodiments, the frequency of drainage channels in the plurality of drainage channels can be between 5 and 7 drainage channels per lineal foot of the cementitious building article along a direction perpendicular to the orientation of the plurality of drainage channels.

In one embodiment, the width of each drainage channel is substantially equivalent or greater than the depth of each drainage channel. In one embodiment, the ratio of the width of each drainage channel to the depth of each drainage channel is approximately 1:1. In a further embodiment, the ratio of the width of each drainage channel to the depth of each drainage channel is approximately 2:1. In other embodiments, the ratio of the width of each drainage channel to the depth of each drainage channel can be less than 2:1, or can be greater than 2:1, for example, 5:1, 8:1, 10:1 and so forth. In one embodiment, each drainage channel comprises a width of between approximately 0.5 mm (0.019 inches) and approximately 7.62 cm (3 inches). In a further embodiment, each drainage channel comprises a depth of between approximately 0.6 mm (0.023 inches) and approximately 5 mm (0.2 inches).

In one embodiment, the plurality of substantially parallel drainage channels are oriented vertically relative to ground level. In a further embodiment, the plurality of substantially parallel drainage channels are oriented horizontally relative to ground level. In another embodiment, the plurality of substantially parallel drainage channels are oriented at an angle between 0° and 90° relative to ground level.

In one embodiment two or more drainage channels are spaced apart from each other by a spacer section. In a further embodiment two or more drainage channels are grouped together in a group or series and each group or series of drainage channels are spaced apart from an each other by a spacer section. In one embodiment, the group or series of drainage channels comprise a series of six drainage channels grouped together. In a further embodiment the group or series of drainage channels comprises between two and six drainage channels within each group or series. In an alternate embodiment, the group or series of drainage channels comprises more than six drainage channels within each group or series. In one embodiment, each group of drainage channels is consistent from one group to the next group. In an alternate embodiment, the number of drainage channels within each group of drainage channels is variable between each group.

Conveniently, in a further embodiment, the or each drainage channel may comprise one or more of a triangular or v-shape, a squared or c-shape, a ribbed or an arcuate configuration. In yet another embodiment, the or each drainage channel may have a profile comprising a combination of more than one shape or configuration. In some aspects, a single cementitious building article may include drainage channels of different configurations.

In one embodiment, the arcuate configuration of each drainage channel can be such that the surface profile comprises at least a portion of a circle. In a further embodiment, the or each drainage channel has an arcuate configuration wherein the angle that is subtended by the arc is less than 180°. In a further embodiment, the squared or c-shape, or ribbed configuration of each drainage channel can be such that the surface profile comprises a base member parallel to the front face and two arms, each arm connecting the base member to a spacer section on the rear face of the of the cementitious building article. In a further embodiment of the invention the angle between the base member and arms of the c-shaped channel is approximately 90° forming a squared c-shaped channel. In a further embodiment, the angle between the base member and the arms of the c-shaped channel could be rounded, bevelled or chamfered to ease the angle from 90° to approximately 45°±20°. In one embodiment, the triangular or v-shape configuration of each drainage channel can be such that the surface profile comprises two side members which terminate at one end of the channel and extend outwardly therefrom forming a v-shape in cross-section.

In a further embodiment, the or each drainage channel may comprise a funneled configuration wherein the or each drainage channel is slightly widened at one or other or both ends of the drainage channel.

In one embodiment the wall cladding panel can comprise a single contiguous fibre cement substrate.

In one embodiment, the weather resistant material is in the form of synthetic material which provides a weather resistant barrier, such as, for example a building or house wrap.

In a further embodiment, the at least one wall cladding panel is fixed to the weather resistant barrier and the building substrate by one or more mechanical fasteners, each mechanical fastener extending through a spacer section of the rear face, the weather resistant barrier, and at least a portion of the building substrate.

In one embodiment, the building system comprises a plurality of wall cladding panels, each wall cladding panel being fixed to the weather resistant barrier and the building substrate.

In another embodiment, a method of mounting a wall cladding panel to a building substrate having a weather resistant barrier mounted thereon is described. The method comprises obtaining a first wall cladding panel comprising a substantially planar front face, a rear face comprising a plurality of substantially parallel drainage channels and a plurality of spacer sections disposed between the drainage channels, and an edge member disposed contiguously between the front face and the rear face, wherein each drainage channel is configured to form a liquid flow path when a substantially planar building surface is placed adjacent to the rear face. The method further comprises placing the first wall cladding panel adjacent to the building substrate such that the rear face is parallel to and abutting the weather resistant barrier, and fixing the first wall cladding panel through the weather resistant barrier to the building substrate to form a plurality of liquid flow paths, each liquid flow path comprising an air gap bounded by a portion of the weather resistant barrier and one of the drainage channels of the rear face.

Fixing the wall cladding panel through the weather resistant barrier to the building substrate can comprise driving one or more mechanical fasteners through the front face, a spacer section of the rear face, the weather resistant barrier, and at least a portion of the building substrate. The method can further comprise fixing a second wall cladding panel through the weather resistant barrier to the building substrate to form a plurality of liquid flow paths, the second wall cladding panel comprising a substantially planar front face and a rear face comprising a plurality of substantially parallel drainage channels, wherein the second wall cladding panel is disposed adjacent to and either above or below the first wall cladding panel, and at least one of the plurality of liquid flow paths formed by the second wall cladding panel is contiguous with one of the plurality of liquid flow paths formed by the first wall cladding panel.

One advantage of the cementitious building article is that the design and position of the drainage channels allow the cementitious building article to be installed onto a structural building frame without the need for furring strips. The integrally formed drainage channels are designed to facilitate drainage and ventilation thereby providing a rain screen system which is easier and cheaper to install than current systems. The configuration and arrangement of the drainage channel are selected to improve the drainage efficiency while at the same time simplify installation process of the building article.

It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

Various embodiments of the fibre cement composite articles and building system will be described in greater detail below.

BRIEF DESCRIPTION OF THE DRAWINGS

FIG. 1A is a view of the rear face of a cementitious building article according to one embodiment showing one configuration of the drainage channels integrally formed therein.

FIG. 1B is an enlarged view of a section of the drainage channels of FIG. 1A.

FIG. 1C is a further enlarged view of a section of the drainage channels of FIG. 1A.

DETAILED DESCRIPTION OF THE PREFERRED EMBODIMENT

Figure 2:
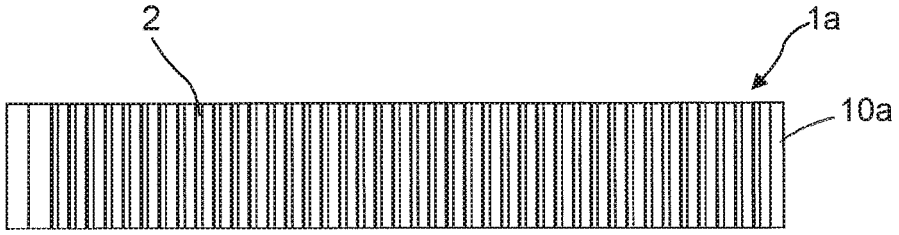
FIG. 2 is a sectional view of a portion of a rear face of one embodiment of the cementitious building article.

References will now be made to the drawings wherein like numerals refer to like parts throughout.

FIGS. 1A, 2, 3A, 3D-3J, 4A, 5A and 6A each show a cementitious building article 1, 1*a*, 3, 3*d*-3*j*, 5, 7 and 9 respectively. Referring specifically to FIG. 3A, cementitious building article 3 comprises a front face 8 and a rear face 10 and an edge member 12 intermediate to and contiguous to the front face 8 and the rear face 10, wherein the front face 8 has a substantially planar surface while the rear face 10 has a non-planar contoured surface. In one embodiment, a plurality of drainage channels 2 are integrally formed on the rear face 10 of the cementitious building article 3. Although not necessarily shown in each of FIGS. 1A, 2, 4A and 6A, it should be understood that each of the cementitious building articles 1, 1*a*, 3, 3*d*-3*j*, 5, 7 and 9 comprise a front face 8, a rear face 10 and an edge member 12 intermediate to and contiguous to the front face 8 and the rear face 10, wherein a plurality of drainage channels 2 are integrally formed on the rear face 10 of the cementitious building article, 1, 1*a*, 3, 3*d*-3*j*, 5, 7 and 9.

The configuration of the drainage channels 2 integrally formed on each of the cementitious building articles 1, 1*a*, 3, 3*d*-3*j*, 5, 7 and 9 is different and will be described in detail below. The configuration or shape of each channel 2 is such that liquid tension forces and capillary action forces are reduced or minimized to facilitate drainage of a liquid through the or each drainage channel and enhance the drainage efficiency of a cementitious building article attached directly to a planar surface of a building without additional furring strips disposed between the surface and the cementitious building article. Furthermore the configuration or shape of the channel 2 is optimized to facilitate circulation of air through each drainage channel 2.

In some embodiments, the cementitious building article 1, 1*a*, 3, 3*d*-3*j*, 5, 7, 9 comprises a plurality of drainage channels 2 which are configured to optimize drainage on the rear face 10 of the cementitious building article.

Referring initially to FIGS. 1A, 1B and 10, the plurality of drainage channels 2 are in the form of a wave configuration on the rear face 10 of a cementitious building article 1. The wave configuration comprises a predetermined number of drainage channels 2 each with a predetermined configuration and dimension. In the configuration shown, a number of the drainage channels 2 are grouped together in a group or series 4 and each group 4 of drainage channels 2 are then spaced apart from an adjacent group 4 of drainage channels 2 by a spacer section 6. In one embodiment, the group or series of drainage channels 4 comprise a series of six drainage channels 2 grouped together. The group or series 4 of drainage channels 2 may also comprise more or less drainage channels 2 within each group or series as desired by the end user. In one embodiment each group 4 of drainage channels 2 is consistent from one group to the next group. In an alternate embodiment, each group 4 of drainage channels 2 is variable between each group. In the embodiment shown in FIGS. 1A-1C, each drainage channel 2 has a squared or c-shaped configuration 2*a*. In other embodiments, drainage channels 2 depicted in FIGS. 1A-1C may have any other configurations as described herein. For example, the drainage channels 2 may have a triangular, ribbed, or arcuate configuration, a square configuration with rounded, bevelled, or chamfered arms, or the like.

In the embodiment shown, the width and depth of each drainage channel 2 together with the frequency of drainage channels 2 within the group or series 4 and the distance separating each group or series 3 of drainage channels 2, is such that the percentage of total surface area occupied by the plurality of drainage channels 2 relative to the total surface area of the cementitious building article 1 is approximately 75%. In alternative embodiments, the width and depth of each drainage channel 2 together with the frequency of drainage channels 2 within the group or series 4 and the distance separating each group or series 3 of drainage channels 2 as depicted in FIGS. 1A-1C, is such that the percentage of total surface area occupied by the plurality of drainage channels 2 relative to the total surface area of the cementitious building article 1 is between 18% and 75%±0.5%. In a further embodiment, a greater portion of the total surface area of the rear face, such as up to approximately 80% of the total surface area of the rear face 10, may be occupied by drainage channels 2. In the embodiment shown in FIGS. 1A-1C, the frequency of drainage channels 2 in the plurality of drainage channels is between 8 and 16 drainage channels per lineal foot of the cementitious building article 1. In alternative embodiments the frequency of drainage channels 2 in the plurality of drainage channels may be more or less frequent, such as between 5 and 7 drainage channels per lineal foot, or up to 20 drainage channels per lineal foot along a direction perpendicular to the orientation of the plurality of drainage channels.

In one embodiment, the width 2*b* of each drainage channel 2 ranges between approximately 0.5 mm to 2.0 mm±0.1 mm. Conveniently the width of the group or series 4 of drainage channels 2 ranges between approximately 5.5 mm and 22.0 mm±0.1 mm. Referring specifically to the embodiment shown in FIG. 1A-1C, the width of each drainage channel 2 is approximately 0.5 mm±0.1 mm and the width of the group or series 4 of drainage channels 2 is approximately 5.5 mm±0.1 mm.

In one embodiment, the group or series 4 of drainage channels 2 are separated from the next group 4 of drainage channels 2 by a spacer section 6 comprising a width 6*a* of approximately 2.5 mm±0.1 mm. One of the advantages of this configuration of the drainage channels 2 integrally formed on the rear face 10 of the cementitious building article 1, is that it facilitates nailing of the cementitious building article 1 to a building substrate. Optionally, the end user can face nail the cementitious building article 1 to a building substrate through the spacer section 6. One advantage of certain embodiments is that the position and width of spacer section 6 is selected to accommodate spacing on a building substrate. In various embodiments, spacer sections 6 can be located between groups 4 of drainage channels 2 and/or may be located between individual drainage channels 2 where drainage channels 2 are organized individually rather than in groups 4. It is to be understood that the width 6*a* of spacer section 6 is variable and the minimum width 6*a* of the spacer section 6 is determined by the configuration of drainage channels 2.

In one embodiment, the depth of each drainage channel 2 ranges between 0.6 and 1.0 mm±0.1 mm. In a further embodiment, the depth of each drainage channel 2 is approximately 0.8 mm±0.1 mm. In other embodiments, the depth of each drainage channel 2 can be larger, such as up to approximately 2 mm, 3 mm, 4 mm, 5 mm, or more. Preferably, the depth of each drainage channel 2 should be limited so as to prevent excessive weakening of the flexural strength of the panel 1 and/or telegraphing of the configuration of the drainage channel 2 to the front face 8.

Figure 3A:
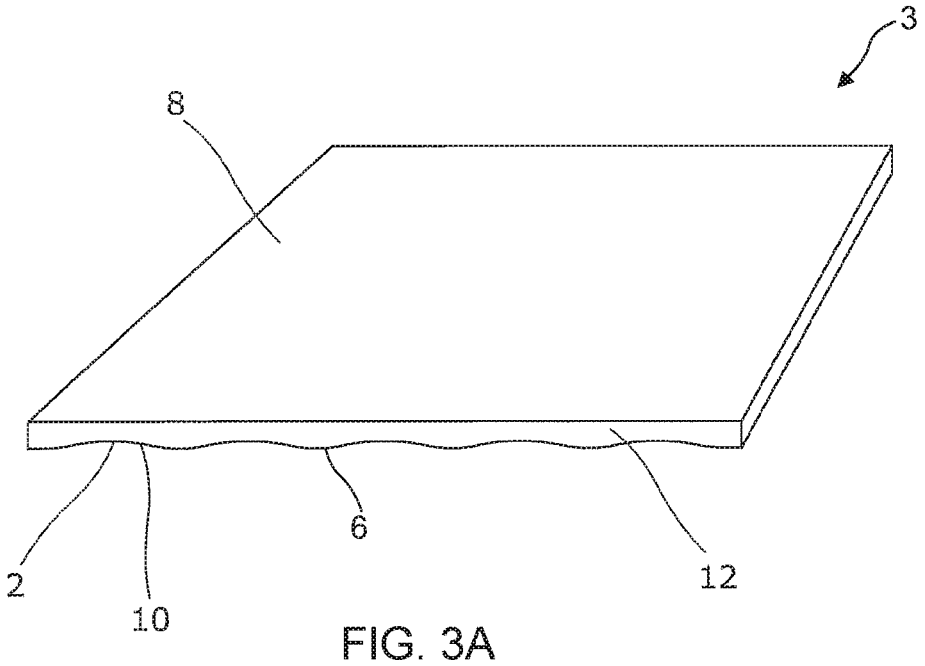
FIG. 3A is a perspective view of one embodiment of a cementitious building article.

FIG. 2 is a sectional view of a portion of a rear face 10*a* of a further embodiment of the cementitious building article disclosed herein. In this embodiment, the plurality of drainage channels 2 integrally formed on the rear face 10*a* of the cementitious building article 1*a* are configured such that the drainage channels 2 are in a continuous series on the rear face 10*a*. As described above with reference to FIGS. 1A-1C, the channels 2 can be any configuration described herein, such as a triangular configuration, a square configuration, a ribbed configuration, an arcuate configuration, and/or a funnel configuration. The channels 2 can be immediately adjacent, or each may be separated by a spacer section or interstice to facilitate fixing of the cementitious building article 1*a* to a building substrate.

Referring now to FIG. 3A, there is shown a perspective view of a cementitious building article 3 comprising a front face 8 and a rear face 10 and an edge member 12 intermediate to and contiguous to the front face 8 and the rear face 10. A plurality of drainage channels 2 are integrally formed on the rear face 10 of the cementitious building article 3 in the form of a wave configuration. In this embodiment, each drainage channel 2 has an arcuate configuration wherein the angle that is subtended by the arc is less than 180°. In the arcuate configuration, at least a portion of the cross-sectional profile of each drainage channel 2 comprises a portion of a circle, e.g., a circular arc. Similar to the embodiments described above with reference to FIGS. 1A-2, the drainage channels 2 in the arcuate configuration may be directly adjacent, or may be separated by a spacer section 6. For example, in the embodiment shown, each drainage channel 2 includes an arc approximately 3.81 cm (1.5") wide and approximately 4 mm-5 mm (0.15"-0.19") deep, with a spacer section 6 of approximately 1.27 cm (0.5") separating each pair of adjacent drainage channels 2.

In the example depicted in FIG. 3A, the spacer section 6 may be a gently curved spacer section 6 where the panel 3 is thicker than the surrounding regions of the panel such that the curved spacer section 6 is a suitable location to drive a mechanical fastener for securing the article 3 to a building substrate. In other embodiments, the channels 2 in an arcuate configuration may be separated by a substantially planar spacer section like spacer section 6 shown in FIGS. 1A and 1B.

Figure 3B:
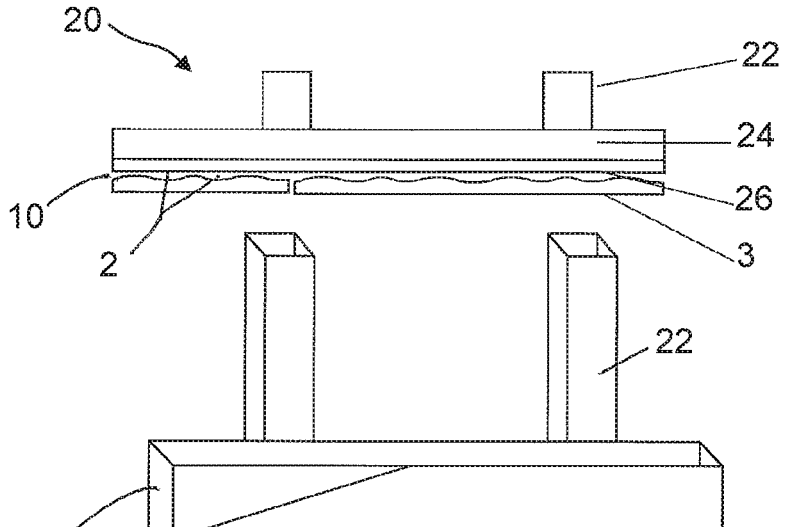
FIG. 3B is a top view of a section of one embodiment of a building system incorporating the cementitious building article of FIG. 3A.
Figure 3C:
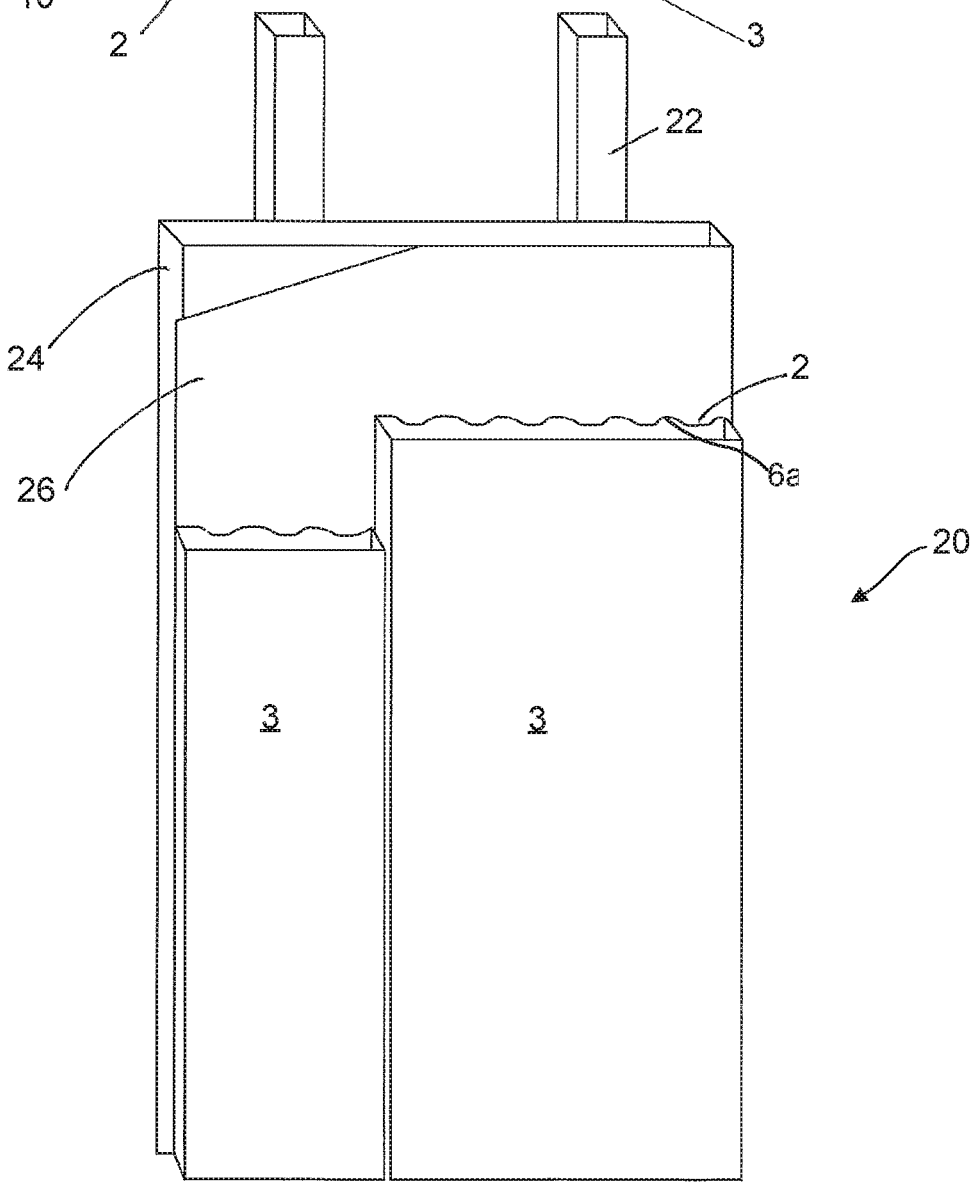
FIG. 3C is a partially cut-away sectional view of the building system of FIG. 3B.

FIGS. 3B and 3C are top and front views respectively of the cementitious building article 3 of FIG. 3A in use in a building system 20. Building system 20 comprises a building substrate 22, oriented strand board (OSB) 24, a weather resistant barrier or house wrap 26 and one or more cementitious building articles 3. In the embodiment of the building system 20 shown, OSB 24 is secured to the building substrate 22. It is to be understood that OSB is an optional feature of the building system 20. House wrap 26 is secured to the front surface of the OSB remote from the building substrate 22 such that the weather resistant barrier or house wrap 26 is locatable intermediate the building substrate 22 and the cementitious building article 3. The cementitious building article 3 is secured to the OSB layer 24 such that the integrally formed drainage channels are adjacent the weather resistant barrier or house wrap layer 26. The optional OSB 24 layer and cementitious building article 3 can be secured to the building substrate 22 using appropriate mechanical or chemical fasteners, for example, adhesives and/or nailing or screw fasteners. In a further embodiment (not shown), the house wrap 26 and one or more cementitious building articles 3 are attached directly to the building substrate 22.

Referring now to FIGS. 3D-3I, cross sectional views are shown of various embodiments of the cementitious building articles described herein. Each of the building articles 3*d*-3*i* depicted in FIGS. 3D-3I includes a substantially planar front face 8*d*-8*i* and a non-planar rear face 10*d*-10*i* having a plurality of integrally formed drainage channels 2*d*-2*i* configured and arranged in a manner so as to provide various preselected drainage efficiencies. The building article 3*d* depicted in FIG. 3D has drainage channels 2*d* in a ribbed configuration, wherein adjacent channels 2*d* are separated by a spacer section 6*d*, and each channel 2*d* includes a substantially planar base 30*d* and two spaced apart sidewalls 34*d* extending from the base 30*d*. The sidewalls 34*d* are disposed at an angle relative to the base 30*d* and the spacer section 6*d* so as to define the sides of the drainage channel 2*d*. The junction between the sidewalls 34*d* and the base 30*d* can define a preselected angle. In the embodiment depicted, the angle is an obtuse angle between 90° and 180°, for example, 120°, 135°, 150°, or any other suitable angle. In some embodiments, an obtuse angle may enhance ease of manufacture and/or durability of the finished building article 3*d* due to the overhanging spacer section 6*d* that would be created by an acute angle. The upper surfaces of the spacer sections 6*d* extend in substantially the same plane such that when the rear face 10*d* of the building article 3*d* is placed adjacent to a building substrate or weather barrier, a trapezoidal air gap is formed by each drainage channel 2*d*.

Figure 3D:
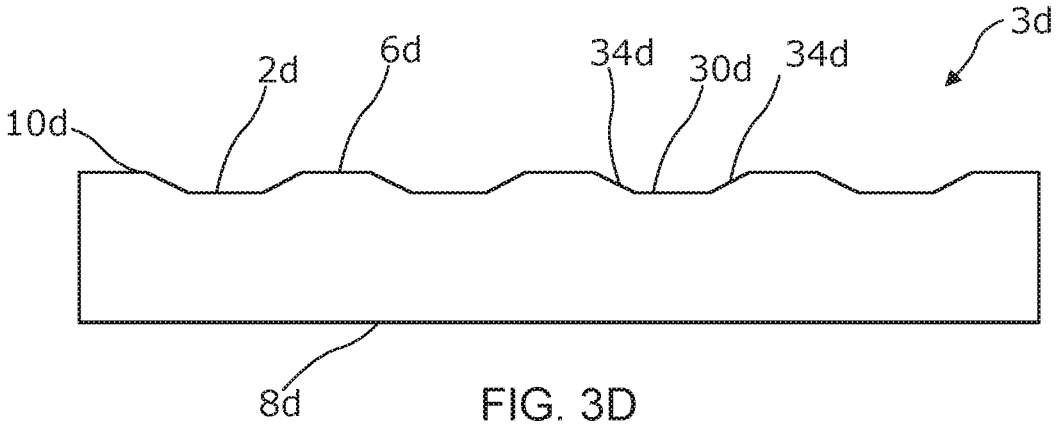
FIGS. 3D-3I are cross sectional views of various embodiments of cementitious building articles.
Figure 3E:
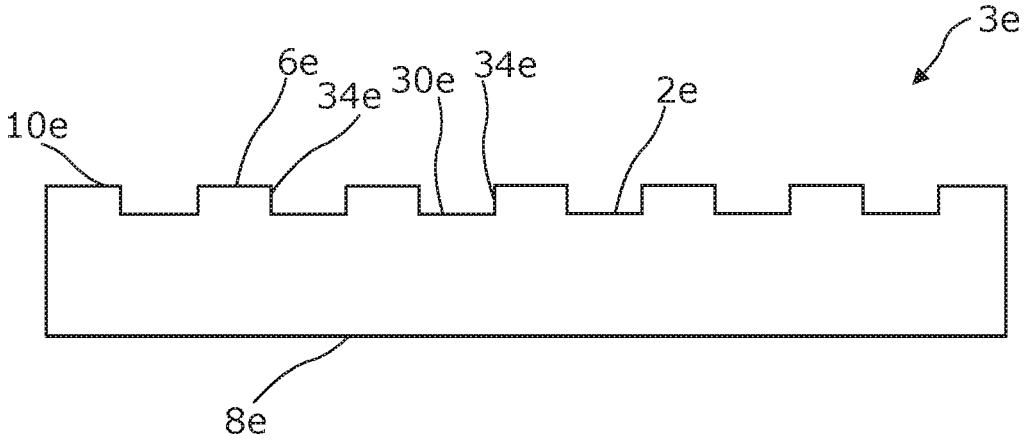

The building article 3*e* depicted in FIG. 3E has drainage channels 2*e* in a squared, or c-shaped, configuration. The drainage channels 2*e* of FIG. 3E are spaced apart by spacer sections 6*e*, and are defined by a substantially planar base 30*e* and two sidewalls 34*e* extending orthogonally from the base 30*e*. As shown in FIG. 3E, the sidewalls 34*e* are disposed substantially perpendicular to the base 30*e* and the spacer sections 6*e*, and the upper surfaces of the spacer sections 6*e* are co-planar. Thus, when the rear face 10*e* of the building article 3*e* is placed adjacent to a building substrate or weather barrier, a rectangular air gap is formed by each drainage channel 2*e*.

Figure 3F:
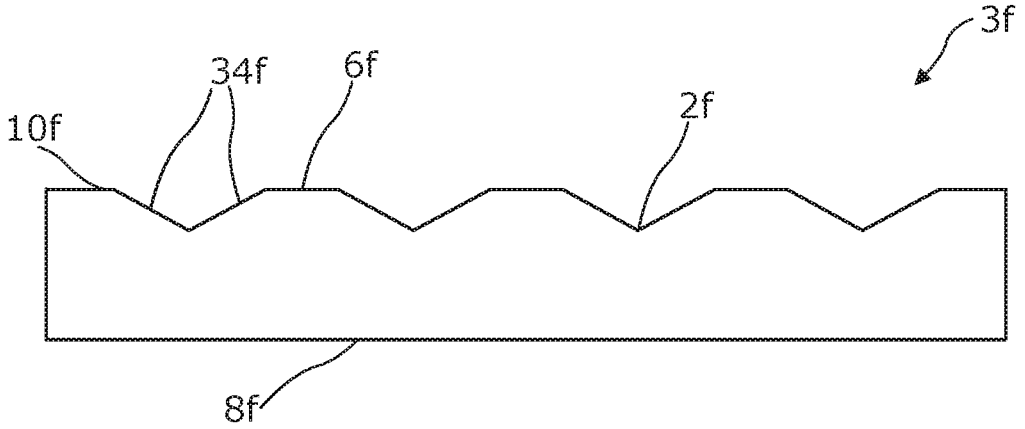

The building article 3*f* depicted in FIG. 3F has drainage channels 2*f* in a triangular, or v-shaped, configuration. In a triangular configuration, the drainage channels 2*f* are spaced apart by spacer sections 6*f* and each channel 2*f* is defined by two sidewalls 34*f*. The two sidewalls 34*f* defining each channel 2*f* extend at an angle relative to the substantially co-planar spacer sections 6*f* and meet at a point approximately halfway between the adjacent spacer sections 6*f*. Thus, when the rear face 10*f* of the building article 3*f* is placed adjacent to a building substrate or weather barrier, a triangular air gap is formed by each drainage channel 2*f*. The angle between each sidewall 34*f* and the adjoining spacer section 6*f* can be any angle between 90° and 180°, such as 120°, 135°, 150°, or any other obtuse angle. In practice, the angle and length of the arms 34*f* can be determined so as to provide drainage channels 2*f* of sufficient depth for efficient drainage, but not so deep as to compromise the strength of the building article 3*f*.

Figure 3G:
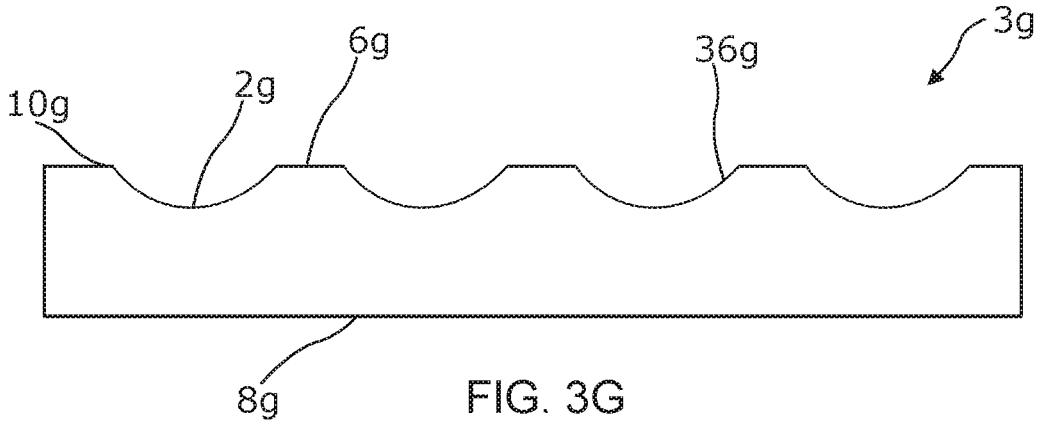

The building article 3*g* depicted in FIG. 3G has drainage channels 2*g* in an arcuate configuration. Similar to the configurations depicted in FIGS. 3D-3F, the building article 3*g* has drainage channels 2*g* separated by substantially co-planar spacer sections 6*g*. However, each drainage channel 2*g* is defined by a single curved channel surface 36*g* extending at an angle from each adjacent spacer section 6*g* in a substantially continuous curve. In various embodiments, the profile of the curved channel surface 36*g* can include a circular arc, a parabolic arc, a freeform curved profile, or any other suitable curved shape. Thus, when the rear face 10*g* of the building article 3*g* is placed adjacent to a building substrate or weather barrier, each drainage channel 2*g* can form an air gap with a profile of a circular segment or parabolic segment.

Figure 3H:
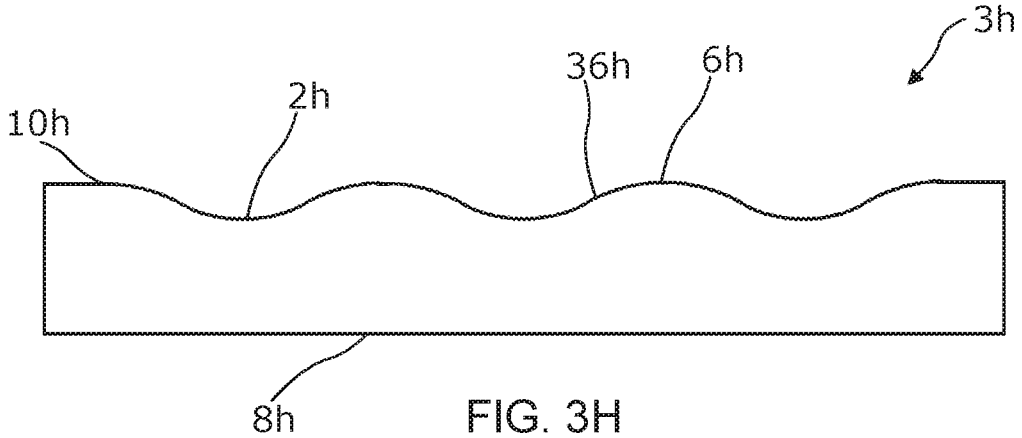

The building article 3*h* depicted in FIG. 3H has drainage channels 2*h* in an alternative arcuate configuration. Similar to the configuration depicted in FIG. 3G, the building article 3*h* has drainage channels 2*h* each defined by a single curved channel surface 36*h*. However, the spacer section 6*h* in the building article 3*h* of FIG. 3H is curved rather than substantially planar. Thus, the rear face 10*h* comprises a continuously curved profile. In some embodiments, the drainage channels 2*h* and spacer sections 6*h* of the rear face 10*h* may form a sinusoidal profile. In other embodiments, the spacer sections 6*h* and the drainage channels 2*h* may have different curvatures. For example, the average radius of curvature in the drainage channel 2*h* section of the rear face 10*h* may be smaller than the average radius of curvature in the spacer sections 6*h* such that a relatively deep drainage channel 2*h* is formed while the spacer section 6*h* has a gentler curve to facilitate coupling to a building substrate. Thus, when the rear face 10*h* of the building article 3*h* is placed adjacent to a building substrate or weather barrier, a bell-shaped air gap is formed by each drainage channel 2*h*.

Figure 3I:
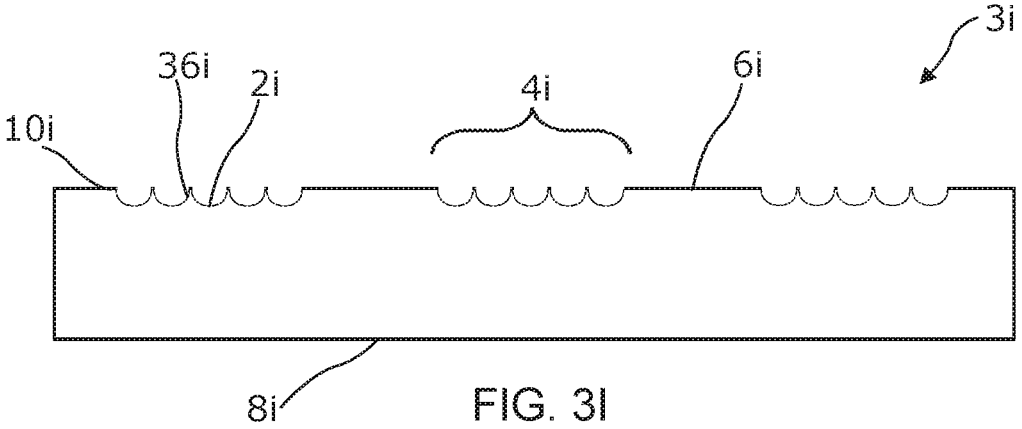

The building article 3*i* depicted in FIG. 3I has drainage channels in a wavy configuration similar to the configuration depicted in FIGS. 1A-1C. The building article 3*i* of FIG. 3I has a plurality of drainage channels 2*i*, each defined by a curved channel surface 36*i*. The drainage channels 2*i* are arranged in groups 4*i* of adjacent channels 2*i* with substantially co-planar spacer sections 6*i* disposed between adjacent groups 4*i* of channels 2*i*, rather than between each pair of channels 2*i*. The drainage channels 2*i* of a wavy or grouped channel configuration like the configuration depicted in FIG. 3I may be narrower than the channels 2*i* of the other configurations described herein. In some aspects, a group 4*i* of narrow drainage channels 2*i* may be advantageous by enhancing the longitudinal flow of water or other liquid along the channel 2*i* and preventing transverse flow, turbulent flow, or other disruption of the intended drainage flow. When the rear face 10*i* of the wavy configuration building article 3*i* is placed adjacent to a building substrate or weather barrier, each group 4*i* of drainage channels 2*i* forms a plurality of circular segment-shaped air gaps.

Various embodiments of the cementitious building articles described herein may have drainage channel configurations including any combination of sub-features described above with reference to FIGS. 3D-3I. For example, some drainage channels 2*d*-2*i* may have profiles including any combination of curved, angled, and/or linear edges. Moreover, any of the drainage channels 2*d*-2*i* depicted in a spaced configuration in FIGS. 3D-3H may equally be implemented in a grouped configuration with groups of adjacent channels 2*d*-2*i* separated by spacer sections 6*d*-6*i*.

Figure 3J:
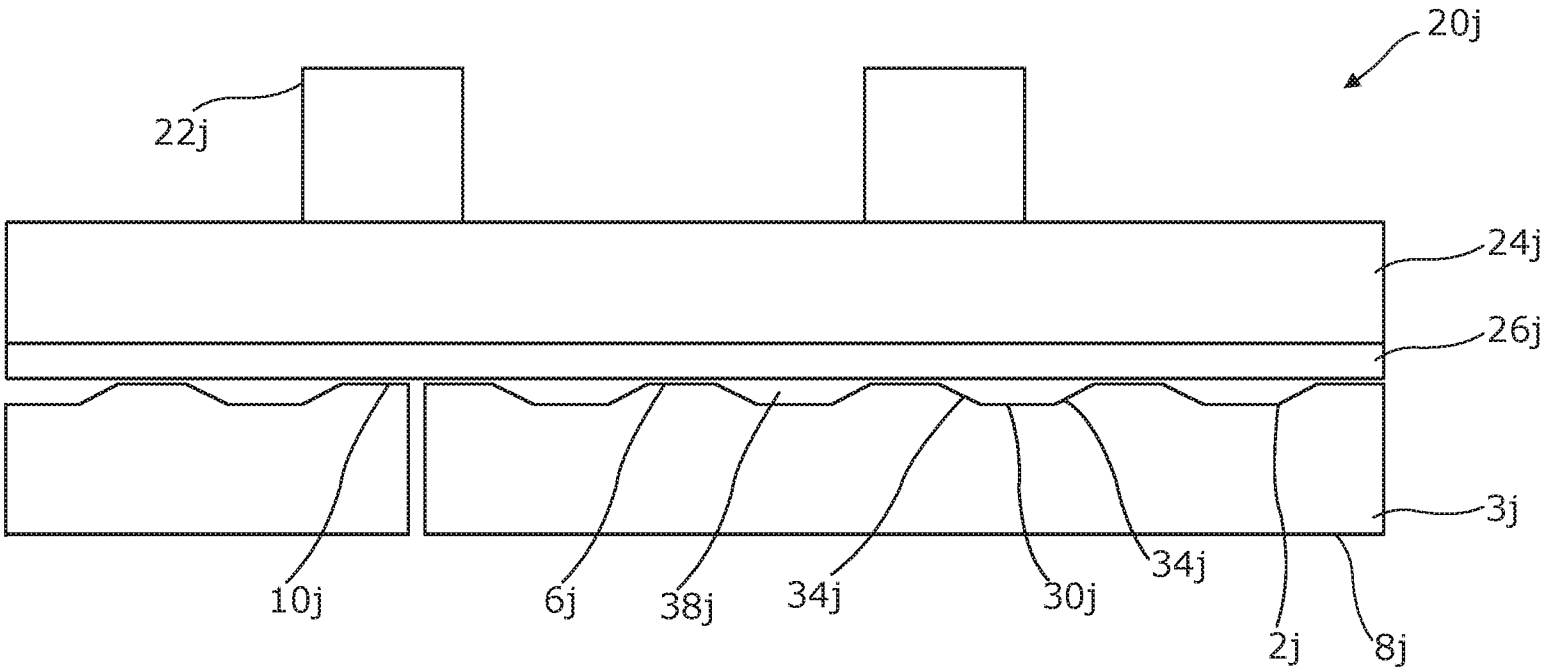
FIG. 3J is a top detail view of a section of one embodiment of a building system incorporating the cementitious building article of FIG. 3D.

FIG. 3J is a detail cross sectional view of a cementitious building article 3*f* consistent with FIG. 3D in use in a building system 20*j*. Similar to the embodiments depicted in FIGS. 3B and 3C, the cementitious building article 3*j* comprises a plurality of drainage channels 2*j* in a spaced configuration, with each adjacent pair of drainage channels 2*j* separated by a substantially planar spacer section 6*j*. In the ribbed configuration depicted, each drainage channel 2*j* has a cross-sectional profile including a substantially planar base 30*j* and two sidewalls 34*j* disposed at opposing sides of the base 30*j*. Each sidewall 34*j* is disposed at an angle relative to the base 30*j* and the substantially co-planar spacer sections 6*j* such that the sidewall 34*j* forms a continuous surface with the base 30*j* and the adjoining spacer section 6*j*.

In the embodiment shown, spacer sections 6*j* further comprise the thickest portions of the building article 3*j*, because the bases 30*j* and sidewalls 34*j* of the drainage channels 2*j* form recesses within the rear face 10*j* of the building article 3*j*. Thus, when the rear face 10*j* is placed against the weather barrier 26*j* covering the OSB layer 24*j* and building substrate 22*j*, the substantially co-planar spacer sections 6*j* lies against the exterior surface of the weather barrier 26*j*. When the spacer sections 6*j* are positioned against the exterior surface of the weather barrier 26*j*, each drainage channel 2*j* forms an air gap 38*j* between the building article 3*j* and the weather barrier 26*j*. The air gap 38*j* extends the length of each drainage channel 2*j* along the surface of the building article 3*j*. The air gap 38*j* can also serve as a fluid flow path, for example, to facilitate the drainage of water or other liquids. Accordingly, the building articles may be mounted to a building substrate 22*j* or OSB layer 24*j* such that the drainage channels 2*j* and associated air gaps 38*j* are oriented vertically with respect to the building and the ground. In such a configuration, gravity can further facilitate the drainage of liquids through the air gap 38*j* for improved drainage efficiency.

Although the building article 3*j* depicted in FIG. 3J has the ribbed configuration depicted in FIG. 3B, the building article 3*j* may equally have any of the drainage channel configurations depicted and described herein. In one embodiment, the building article 3*j* of FIG. 3J has the squared or c-shaped drainage channel configuration depicted in FIG. 3E. In one embodiment, the building article 3*j* of FIG. 3J has the triangular or v-shaped drainage channel configuration depicted in FIG. 3F. In one embodiment, the building article 3*j* of FIG. 3J has the arcuate drainage channel configuration depicted in FIG. 3G. In one embodiment, the building article 3*j* of FIG. 3J has the continuously curved arcuate drainage channel configuration depicted in FIG. 3H. In one embodiment, the building article 3*j* of FIG. 3J has the grouped drainage channel configuration depicted in FIG. 3I.

Referring jointly to FIGS. 3A-3J, the drainage efficiency of a building article 3, 3*d*-3*j* installed in a building system 20, 20*j* can depend, at least in part, on the cross-sectional area of the fluid flow path provided by the air gap 38*j* defined by the weather barrier 26, 26*j* and each drainage channel 2, 2*d*-2*j*. Accordingly, the dimensions of the spacer sections 6, 6*d*-6*j*, bases 30, sidewalls 34*d*-34*f*, and curved channel surfaces 36*g*-36*i* of the various embodiments depicted can be selected so as to provide for an air gap 38*j* having a desired cross-sectional area. For example, the cross-sectional area A of the trapezoidal air gap 38*j* depicted in FIG. 3J can be calculated by the equation $A=\frac{1}{2}(d)(a+b)$, where d is the depth of the channel 2*j* between the weather barrier 26*j* and the base 30*j*, a is the length of the base 30*j*, and b is the length of the portion of the weather barrier 26*j* that forms a boundary of the air gap 38*j*. In another example, if the building article 3*j* of FIG. 3J has a squared drainage channel configuration, the cross-sectional area A of the air gap 38*j* can be calculated by $A=d\times a$, where d is the depth of the channel 2*j* between the weather barrier 26*j* and the base 30*j*, and a is the length of the base 30*j*. In a third example, if the building article 3*j* of FIG. 3J has a triangular drainage channel configuration as depicted in FIG. 3F, the cross-sectional area A of the air gap 38*j* can be calculated by $A=\frac{1}{2}(d\times b)$, where d is the depth of the channel 2*j* between the weather barrier 26*j* and the intersection point between the two sidewalls 34*j*, and b is the length of the portion of the weather barrier that forms a boundary of the air gap 38*j*. In yet another example, if the building article 3*j* of FIG. 3J has a circular arcuate configuration as depicted in FIG. 3G, the cross-sectional area A of the air gap 38*j* can be calculated by $A=\frac{1}{2}R^2(\theta-\sin\theta)$, where R is the radius of the circle that includes the curved channel surface, and e is the central angle of the circle subtending the arc length of the curved channel surface.

Although only a section of the building substrate is shown, it is to be understood that the cementitious building article 3, 3*j* can be arranged in series in one or more directions to cover or clad either a required area on the building substrate or the entire building. When a plurality of cementitious building articles 3, 3*j* are arranged vertically in series, it will be appreciated that one or more drainage channels 2, 2*j* of each building article 3, 3*j* may align such that a contiguous liquid flow path is formed extending along the vertical length of the multiple building articles 3, 3*j*. Such alignment may be advantageous in allowing water or other liquid to drain from an article 3, 3*j* mounted relatively high on a wall, to the ground and away from the building to which the articles 3, 3*j* are mounted.

In the embodiments shown, each of cementitious building articles 3, 3*j* are oriented such that drainage channels 2, 2*j* extend substantially vertically relative to ground level. It is to be understood that although this is a preferred orientation of the cementitious building articles, the cementitious building articles are not limited to this particular orientation and other orientations as determined by the end user are also possible. For example, drainage channels 2, 2*j* may extend horizontally or at any angle between vertical and horizontal relative to ground level.

One of the advantages of this building system is that the cementitious building article 3, 3*j* can be secured to a building substrate 22, 22*j* without the use of furring strips. The drainage channels 2, 2*j* on the rear face 10, 10*j* of the cementitious building article 3, 3*j* are configured to form a capillary break and air gap to facilitate drainage and moisture management between the cementitious building article 3, 3*j* and the building substrate 22, 22*j* and/or OSB layer 24, 24*j*. The drainage efficiency of the building system without furring strips may be similar or equal to the drainage efficiency of pre-existing rain screen systems with furring strips. However, it is also possible to use furring strips if so desired with any one of the cementitious building articles described herein.

In a further embodiment of the present disclosure, screening devices are optionally used at one or more opposing ends of a drainage channel to prevent debris or insects from entering and blocking the drainage channel. In various embodiments, the depth and/or width of the drainage channels 2, 2*j* may be small enough that a screening device may not be necessary.

It will be appreciated that the building systems 20, 20*j* depicted in FIGS. 3B, 3C, and 3J can equally be implemented with any of the other cementitious building articles 1, 1*a*, 5, 7, 9 depicted and described elsewhere herein. Moreover, any of the channel configurations described herein can be included in the building system 20, 20*j*. For example, the rear face 10, 10*j* of building articles 3, 3*j* fixed to the building substrate 22, 22*j* in building system 20, 20*j* can include drainage channels in a triangular configuration, a square configuration, a ribbed configuration, a funnel configuration, and/or any combination thereof.

In a further embodiment, it is possible for the front face 8, 8*d*-8*j* of the cementitious building article 1, 1*a*, 3, 3*d*-3*j*, 5, 7, 9 to comprise a variety of styles or shapes, including profiled or embossed faces. For example, the front face 8, 8*d*-8*j* may be embossed with a pattern resembling wood grain or any other desired texture to enhance the appearance of the exterior of a building. The front face 8, 8*d*-8*j* may further be painted and/or primed for painting by a user.

In one embodiment, the cementitious building article 1, 1*a*, 3, 3*d*-3*j*, 5, 7, 9 is a fibre cement building article wherein the fibre cement building article comprises cellulose fibres, hydraulic binders, silica and water. Optionally the fibre cement building article 1, 1*a*, 3, 3*d*-3*j*, 5, 7, 9 further comprises other additives, for example density modifiers. In one embodiment, the fibre cement building article 1, 1*a*, 3, 3*d*-3*j*, 5, 7, 9 comprises a fibre cement panel having a front face 8, 8*d*-8*j* and a rear face 10, 10*d*-10*j* and an edge member 12 intermediate to and contiguous to the front face 8, 8*d*-8*j* and the rear face 10, 10*d*-10*j*, wherein the distance between the front face 8, 8*d*-8*j* and the rear face 10, 10*d*-10*j* comprises at least 0.8 mm±0.5 mm. In one embodiment, the distance between the front face 8, 8*d*-8*j* and the rear face 10, 10*d*-10*j* at the spacer sections is approximately 7.62 cm (0.3"). In one embodiment, the building article 1, 1*a*, 3, 3*d*-3*j*, 5, 7, 9 is approximately 1.2 m (4 feet) wide and includes 22 channels. It is understood that the building article is not limited to this specific size. In one embodiment, the fibre cement building article is formed by thin overlaying substrate layers using the Hatschek process.

Figure 4C:
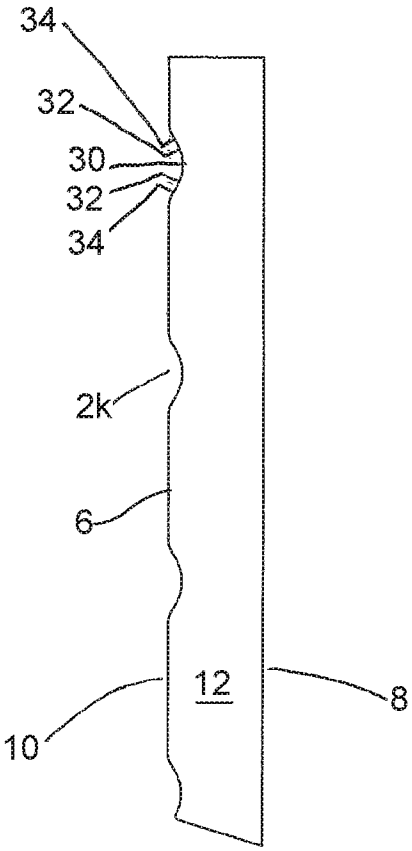
FIG. 4C is an enlarged side view of a section of the cementitious building article of FIG. 4A.
Figure 4B:
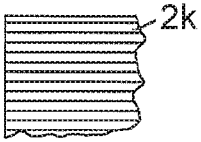
FIG. 4B is an enlarged view of section A-A of FIG. 4A.
Figure 4A:
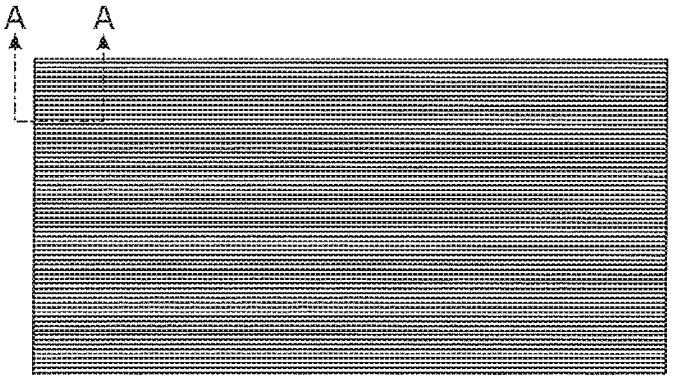
FIG. 4A is a view of the rear face of a further embodiment of the cementitious building article.

In FIGS. 4A, 4B and 4C, there is shown an example of a cementitious building article 5, wherein the drainage channels 2*k* comprise a ribbed configuration similar to the configuration shown in FIG. 3D, however in this embodiment the cross-section channel surface profile appears substantially curved. Drainage channel 2*k* comprises a base 30 and two sidewalls 34, wherein the base 30 comprises a planar section and two angled sections 32. Arms 34 of the ribbed channel configuration project from opposing sides of the base member 30. Each angled section 32 extends outwardly from the base member such that each angled section 32 is positioned between the base member and arms. A base member may be substantially planar having a planar base member 30 with angled sections 32 at the ends of the base member 30. Each arm 34 extends from an end of a base member 30 to connect the base member 30 to an edge of the adjacent spacer section 6. In some embodiments of the ribbed configuration, drainage channels 2*k* may be adjacent to each other without spacer sections 6.

In a further embodiment, it is possible for the front face 8 of the cementitious building article to comprise a variety of styles or shapes, including profiled or embossed faces. For example, the front face 8 may be embossed with a pattern resembling wood grain or any other desired texture to enhance the appearance of the exterior of a building. The front face 8 may further be painted and/or primed for painting by a user.

In a further embodiment, at least one or more faces of the cementitious building articles 1, 1*a*, 3, 3*d*-3*j*, 5, 7, 9 further comprise a coating agent. In one embodiment, the or each drainage channel 2, 2*d*-2*k* are coated to further assist drainage action and the capillary break functionality of the or each drainage channel. For example, a coating agent may provide a smoother surface than an uncoated cementitious building article, so as to further facilitate the flow of water or any other liquid along the surface of the cementitious building article 5. Enhanced flow of water along the surface of the building article can further enhance the drainage efficiency of the cementitious building article 5.

In a further embodiment, the cementitious building article 5 is a primed or painted cementitious building article ready for installation on a building structural substrate.

In one embodiment, the cementitious building article is a fibre cement building article wherein the fibre cement building article comprises cellulose fibres, hydraulic binders, silica and water. Optionally the fibre cement building article further comprises other additives, for example density modifiers. In one embodiment, the fibre cement building article comprises a fibre cement panel having a front face and a rear face and an edge member intermediate to and contiguous to the front face and the rear face wherein the distance between the front face and the rear face comprises at least 0.8 mm±0.5 mm. In one embodiment, the fibre cement building article is formed by thin overlaying substrate layers using the Hatschek process.

Figure 5A:
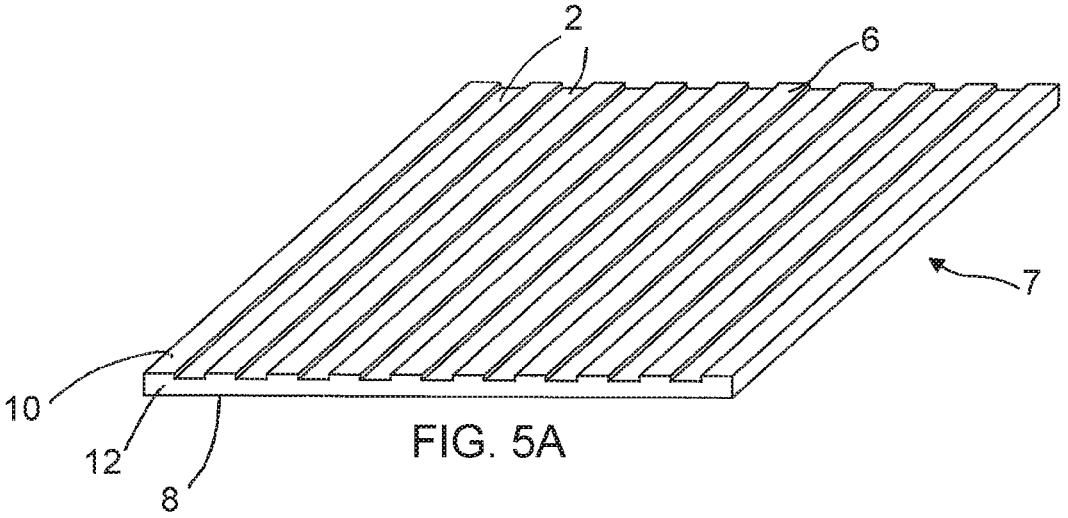
FIG. 5A is view of the rear face of a further embodiment of the cementitious building article.
Figure 5B:
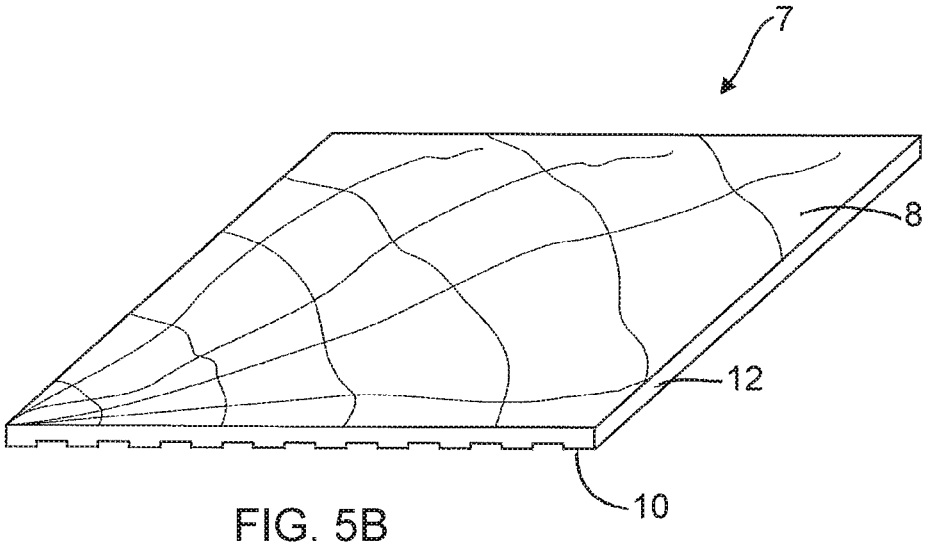
FIG. 5B is a view of the front face of the embodiment of the cementitious building article shown in FIG. 5A.

Referring now to FIGS. 5A and 5B, an example of a fibre cement building article 7 is shown wherein a plurality of squared or c-shaped drainage channels 2 are integrally formed on the rear face 10 of cementitious building article 7. Front face 8 of fibre cement building article 7 is flat and smooth. In various embodiments, front face 8 may also be textured, profiled, embossed, primed, painted, or otherwise prepared to form an exterior surface of a building. In some embodiments, portions of the fibre cement building article 7 between squared drainage channels 2 form spacer sections 6. Spacer sections 6 may advantageously accommodate a mechanical fastener for mounting to a building substrate to form a wall section such as the wall section of the building system 20, 20*j* depicted in FIGS. 3B, 3C, and 3J.

Figure 6A:
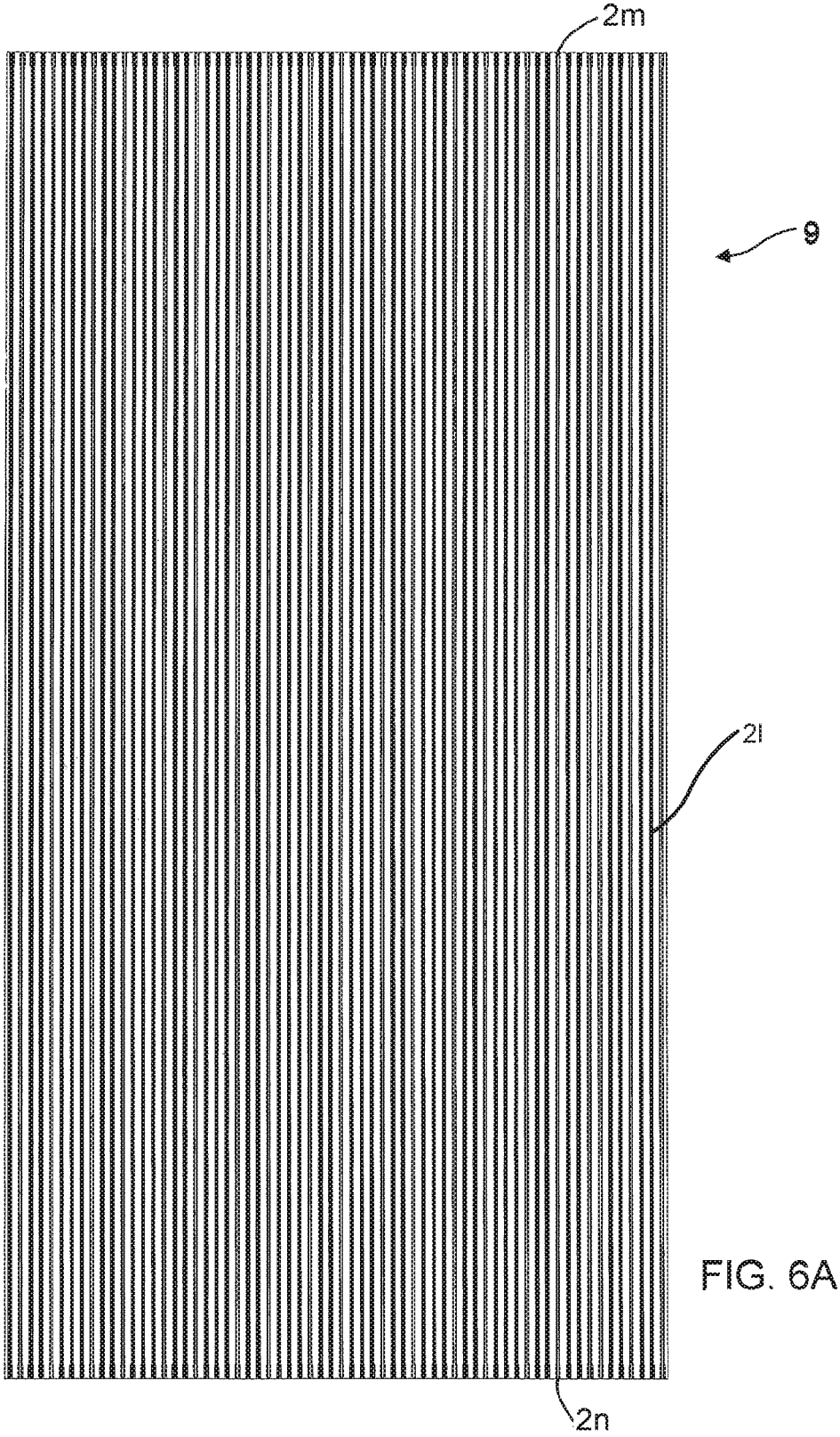
FIG. 6A is a view of the rear face of a further embodiment of the cementitious building article.
Figure 6B:
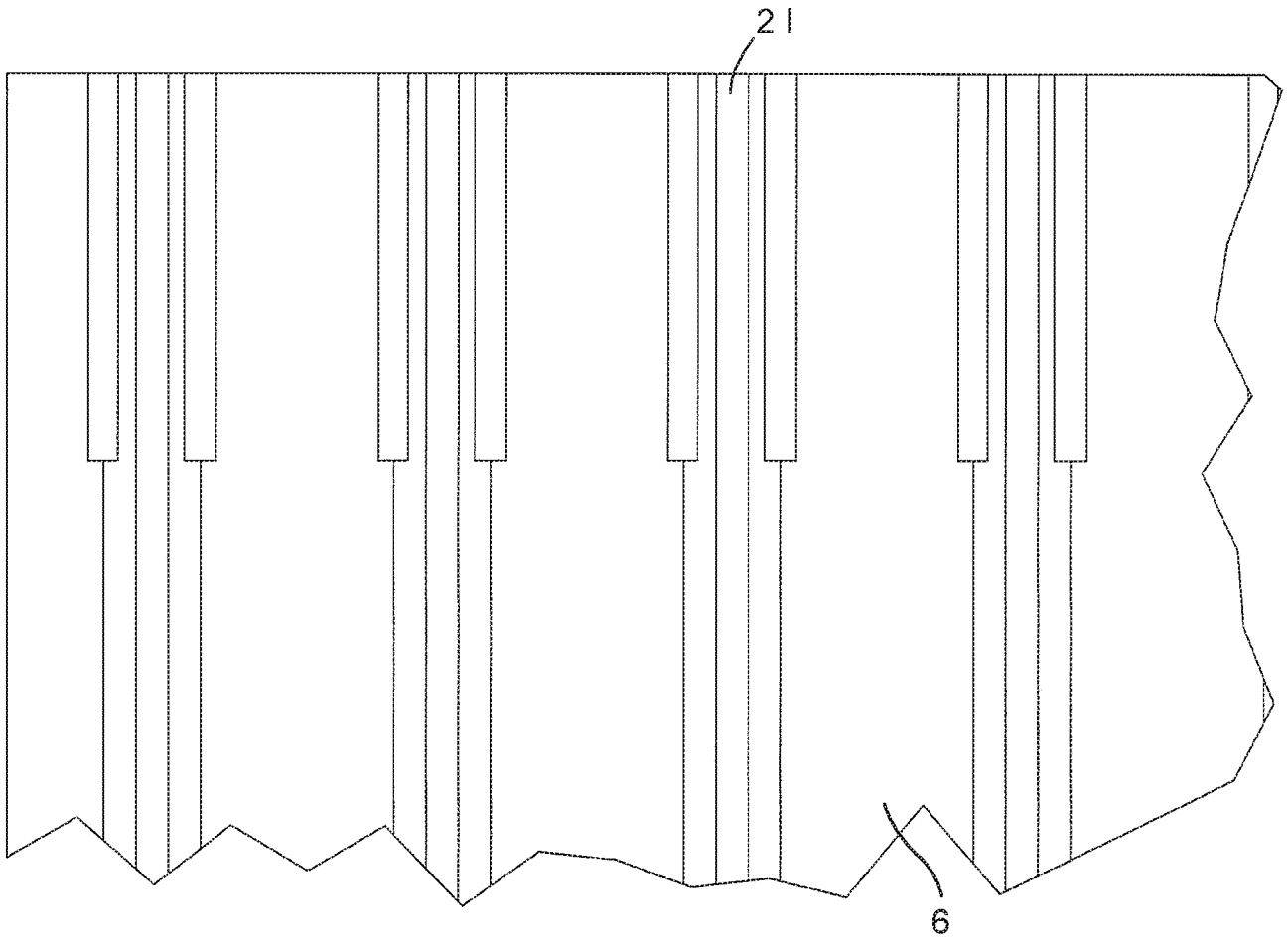
FIG. 6B is an enlarged view of a section of the rear face of FIG. 6A.

Referring now to FIGS. 6A and 6B, a further embodiment of a cementitious building article 9 comprises drainage channels 2*l* having a funneled configuration wherein the or each drainage channel is slightly widened at both ends 2*m*, 2*n* of the drainage channel 2*l*. Accordingly, the width of the spacer section 6 may be narrower between ends 2*m*, 2*n* of the drainage channel 2*l*. It will be appreciated that the funneled configuration depicted in FIGS. 6A and 6B may be implemented with any of the embodiments described and/or depicted herein. For example, any of cementitious building articles 1, 1*a*, 3, 3*d*-3*j*, 5, 7 as depicted in FIGS. 1A-5B may be implemented such that the ends of the or each drainage channel is wider than the remaining portion of the or each drainage channel, such as to facilitate liquid flow into or out of each drainage channel. Funneled drainage channels 2*l* may further have any configuration described herein, for example, a triangular, squared, arcuate and/or ribbed cross-sectional profile as depicted elsewhere herein.

Advantageously, referring now to all embodiments depicted in FIGS. 1A-6B, the dimensions of the or each drainage channel 2, 2*d*-2*l* integrally formed on the rear face 10 of the fibre cement building article 1, 1*a*, 3, 3*d*-3*j*, 5, 7, 9 are such that the depth of the or each drainage channel 2, 2*d*-2*l* enables production of a fibre cement building article 1, 1*a*, 3, 3*d*-3*j*, 5, 7, 9 comprising integrally formed drainage channels 2, 2*d*-2*l* without the occurrence of telegraphing through to the front face 8 of the fibre cement building article 1, 1*a*, 3, 3*d*-3*j*, 5, 7, 9 whilst the or each drainage channel 2, 2*d*-2*l* functions to provide drainage and capillary break.

In a further embodiment, there is provided a method of manufacturing a fibre cement composite article, the method comprising the steps of:

(a) providing a fibre cement green sheet comprising a front face and a rear face and an edge member intermediate to and contiguous to the front face and the rear face;

(b) forming a non-planar surface on the rear face of the fibre cement green sheet, said non-planar surface configured to form a plurality of drain channels; and (c) curing the fibre cement green sheet to form a fibre cement building article comprising drainage channels integrally formed on the rear face of the fibre cement building article.

In a further embodiment, the drainage channels formed at step (b) are integrally formed on the rear face of the fibre cement green sheet using one or more of the following techniques, rolling, embossing, pressing, cutting or other suitable techniques known to the person skilled in the art.

In one embodiment, the method of manufacturing a fibre cement building article optionally comprises the further step of profiling or embossing the front face of the fibre cement building article. Optionally, the drainage channels integrally formed on the rear face of a fibre cement building article comprising a profiled or embossed front face at step (b) of the method are formed to a greater depth than required after curing to accommodate any loss of depth that may occur in the or each drainage channel during the step of profiling or embossing the front face of the fibre cement building article.

In a further embodiment, the method of manufacturing a fibre cement building article optionally comprises the further step (d) coating one or more of the plurality of drainage channels integrally formed on the rear face of the fibre cement building article.

Examples

Drainage Testing

A series of drainage efficiency tests were carried out in accordance with the ASTM E2273 standard test method for determining the drainage efficiency of exterior insulation and finish systems (EIFS) clad wall assemblies. As described elsewhere herein, drainage efficiency can be a significant consideration in determining the adequacy of a rain screen system. For example, because existing rain screen systems with furring strips can provide over 90% drainage efficiency, it may be desirable for the cementitious building articles described herein to similarly be capable of providing drainage efficiency greater than 90% without the use of furring strips.

The control samples comprised a fibre cement panel which had no drainage channels integrally formed on the rear face of the sample in accordance with embodiments of the present disclosure. The drainage efficiency was measured on control samples which had coated and uncoated rear surfaces. The coating that was used was a primer solution.

Samples of an equivalent fibre cement panel to that of the control comprising drainage channels integrally formed on the rear face of the sample in accordance with embodiments of the present disclosure were prepared. Sample A comprised fibre cement panels having drainage channels with an arcuate configuration formed therein similar to the configuration shown in FIG. 3G whilst Sample B comprised fibre cement panels having drainage channels with a v-shaped or triangular configuration formed therein similar to the configuration shown in FIG. 3F. The drainage efficiency of samples A and B were measured wherein the drainage channels integrally formed on the rear face were (a) coated with a primer solution and (b) uncoated. The results of the drainage efficiency tests are presented below in Table 1.

TABLE 1

Results of drainage efficiency tests of example cementitious building articles described herein.

| | Control % Drainage Efficiency | Sample A % Drainage Efficiency | Sample B % Drainage Efficiency |
|---|---|---|---|
| Uncoated 1 | 70.1 | 90.3 | 90.9 |
| Uncoated 2 | 73.3 | 90.6 | 91.4 |
| Uncoated 3 | 71.8 | 90.5 | 90.7 |
| Average | 71.73 | 90.47 | 91.00 |

TABLE 1-continued

Results of drainage efficiency tests of example cementitious building articles described herein.

| | Control % Drainage Efficiency | Sample A % Drainage Efficiency | Sample B % Drainage Efficiency |
|---|---|---|---|
| % Drainage Efficiency Standard Deviation | 1.60 | 0.15 | 0.36 |
| Coated 1 | 81.3 | 95.1 | 95.3 |
| Coated 2 | 77 | 95.3 | 95.1 |
| Coated 3 | 78.2 | 95.7 | 95.8 |
| Average | 78.83 | 95.37 | 95.40 |
| % Drainage Efficiency Standard Deviation | 2.22 | 0.31 | 0.36 |

The drainage efficiency of a fibre cement building article without drainage channels and without a coated surface is approximately 71.7% when measured using ASTM E2773. This efficiency increases to approximately 78.8% when a primer solution is applied to the rear face including the drainage channels of the fibre cement building article.

The drainage efficiency of a cementitious building article with drainage channels and having either an arcuate or v-shaped configuration integrally formed therein in accordance with embodiments of the present disclosure increased significantly relative to the control experiments. The drainage efficiency of Sample A with the arcuate configuration increased to an average drainage efficiency of 90.5% without a coating and to 95.4% when a primer coating was applied to the rear surface including drainage channels of the fibre cement building article. The drainage efficiency of Sample B with the v-shaped configuration increased to an average drainage efficiency of 91% without a coating and to 95.4% when a primer coating was applied to the rear surface.

Strength Testing

A series of tests were carried to determine the flexural strength or modulus of rupture (MoR) of the control samples, sample A and sample B. The sample size for each test was n=18.

As for the drainage tests the control samples comprised a fibre cement panel which had no drainage channels integrally formed on the rear face of the sample in accordance with embodiments of the present disclosure. Whilst Sample A comprised fibre cement panels having drainage channels with an arcuate configuration formed therein and Sample B comprised fibre cement panels having drainage channels with a v-shaped configuration formed therein. The results of the flexural strength tests are presented below in Table 2.

TABLE 2

Results of flexural strength tests of example cementitious building articles described herein.

| | Control MoR/MPa | Sample A MoR/MPa | Sample B MoR/MPa |
|---|---|---|---|
| 1 | 10.041 | 12.39 | 10.477 |
| 2 | 10.43 | 10.78 | 10.864 |
| 3 | 10.023 | 11.10 | 10.766 |
| 4 | 10.339 | 10.31 | 10.542 |
| 5 | 10.468 | 10.31 | 10.468 |
| 6 | 9.726 | 10.53 | 10.164 |
| 7 | 10.315 | 10.741 | 10.742 |
| 8 | 10.368 | 11.061 | 10.521 |
| 9 | 10.748 | 10.982 | 10.546 |
| 10 | 10.399 | 10.862 | 10.578 |
| 11 | 10.277 | 10.927 | 10.818 |
| 12 | 10.655 | 10.612 | 10.788 |

TABLE 2-continued

Results of flexural strength tests of example cementitious building articles described herein.

| | Control MoR/MPa | Sample A MoR/MPa | Sample B MoR/MPa |
|---|---|---|---|
| 13 | 11.198 | 10.614 | 11.098 |
| 14 | 11.134 | 10.764 | 11.204 |
| 15 | 10.757 | 10.802 | 11.368 |
| 16 | 10.734 | 10.329 | 11.468 |
| 17 | 10.787 | 10.437 | 11.287 |
| 18 | 11.055 | 10.861 | 10.883 |
| Average MoR/MPa | 10.53 | 10.8 | 10.81 |
| Standard Deviation | 0.38 | 0.46 | 0.35 |

The results indicate that there is little difference between the flexural strength of the control and the fibre cement panel with drainage channels integrally formed in the rear face of the fibre cement panel irrespective of the shape or configuration of the drainage channel.

Smoothness Testing

The surface smoothness of a number of control samples and samples of a fibre cement panel comprising drainage channels integrally formed on the rear face of the sample were measured.

As before the control samples comprised a fibre cement panel which had no drainage channels integrally formed on the rear face of the sample in accordance with the embodiments of the present disclosure. Sample A comprised fibre cement panels having drainage channels with an arcuate configuration formed therein whilst Sample B comprised fibre cement panels having drainage channels with a v-shaped configuration formed therein. The results of the surface smoothness tests are presented below in Table 3.

TABLE 3

Results of smoothness tests of example cementitious building articles described herein.

| | Control | Sample A | Sample B |
|---|---|---|---|
| 1 | 14.52 | 14.23 | 13.9 |
| 2 | 14.65 | 14.86 | 13.62 |
| 3 | 13.85 | 14.85 | 13.7 |
| 4 | 14.59 | 14.62 | 13.22 |
| 5 | 14.54 | 14.81 | 13.55 |
| 6 | 13.89 | 14.78 | 13.75 |
| 7 | 13.76 | 14.73 | 13.77 |
| 8 | 14.36 | 14.22 | 13.75 |
| 9 | 14.59 | 15.1 | 13.4 |
| 10 | 14.47 | 14.98 | 13.27 |
| 11 | 14 | 15.05 | 13.5 |
| 12 | 13.95 | 14.93 | 13.29 |
| 13 | 14.64 | 14.82 | 13.3 |
| 14 | 14.51 | 14.73 | 13.85 |
| 15 | 14.59 | 15.18 | 13.06 |
| 16 | 14.35 | 14.51 | 13.92 |
| 17 | 14.4 | 15.15 | 13.33 |
| 18 | 13.88 | 14.54 | 13.39 |
| Average | 14.31 | 14.78 | 13.53 |
| Standard Deviation | 0.32 | 0.28 | 0.26 |

The results indicate that there is little difference between the surface smoothness of the front face of the fibre cement panel with or without drainage channels integrally formed in the rear face of the fibre cement panel.

Hydrostatic Pressure Testing

If a cementitious building article is secured to a building substrate without the presence of a capillary break or a rain screen it is known that hydrostatic pressure exists which hinders drainage. A number of calculations were performed to determine the hydrostatic pressure and % increase of same for a number of configurations of the drainage channel together with the frequency of drainage channels per 1.22 m (4 ft.) panel width.

In the following calculations, a number of assumptions were made: the water tank was deemed to be 0.6 m (2') wide with a water column of 2.54 cm (1"). The fibre cement panel had a distance of 8 mm (0.32") between the front and rear surface of the fibre cement panel. The fiber cement panel also had drainage channels integrally formed on the rear surface. Other measurements regarding the frequency and the cross sectional area of the drainage channel are presented below in Table 4.

The following is a sample of the calculations carried out for a fibre cement panel having 36 drainage channels with an arcuate configuration integrally formed on the rear surface. All other calculations followed a similar process. The results of the calculations are presented in Table 4 below.

(a) Volume of water in the drainage test=60.96 cm×2.54 cm and 0.8 cm=123 $cm^3$ (cc).

(b) Mass of stored water=Density of water×Volume of water=1 g per $cm^3$×123 $cm^3$=123 g.

(c) Force applied by stored water=mass of water×acceleration due to gravity=123 g×981 $cm/s^2$=120663 dyne.

(d) Hydrostatic pressure-applied=force per unit area=120663 dyne×(60.96 cm×0.8 cm)=2477 Pa.

(e) Hydrostatic pressure-applied by modified design=force per unit area=120663 dyne×[(60.96 cm×0.8 cm)−(36×0.24 $cm^2$)=3007 Pa.

(f) Improved forces due to drainage channels=(Hydrostatic pressure-applied by modified design (e)−Hydrostatic pressure-applied (d))×100%=(3007−2477)×100%=21.4%

TABLE 4

Results of hydrostatic pressure tests of example cementitious building articles described herein.

| ID | Channel Shape | Channel x-section area | Number of Channels | Hydrostatic pressure applied by the modified design | Improvement (%) |
|---|---|---|---|---|---|
| 1 | Arc | 0.24 | 24 | 2806 | 13 |
| 2 | Arc | 0.24 | 36 | 3007 | 21 |
| 3 | Arc | 0.24 | 48 | 3240 | 30 |
| 4 | Square | 0.12 | 24 | 2629 | 6 |
| 5 | Square | 0.12 | 36 | 2715 | 9 |
| 6 | Square | 0.12 | 48 | 2806 | 13 |
| 7 | Triangular | 0.06 | 24 | 2550 | 2 |
| 8 | Triangular | 0.06 | 36 | 2589 | 4 |
| 9 | Triangular | 0.06 | 48 | 2629 | 6 |

The calculations show that drainage channels integrally formed in the rear surface of the fibre cement building article accordance with embodiments of the present disclosure increase hydrostatic pressure relative to the hydrostatic pressure applied by the mass of stored water. Furthermore it was also shown that hydrostatic pressure increases as the number of channels increase. Accordingly the configuration of the or each drainage channel together with frequency of drainage channels provides for water or a liquid to flow through the drainage channels.

The foregoing description of the preferred embodiments of the present disclosure has shown, described and pointed out the fundamental novel features of the inventions. The various devices, methods, procedures, and techniques described above provide a number of ways to carry out the described embodiments and arrangements. Of course, it is to be understood that not necessarily all features, objectives or advantages described are required and/or achieved in accordance with any particular embodiment described herein. Also, although the invention has been disclosed in the context of certain embodiments, arrangements and examples, it will be understood by those skilled in the art that the invention extends beyond the specifically disclosed embodiments to other alternative embodiments, combinations, sub-combinations and/or uses and obvious modifications and equivalents thereof. Accordingly, the invention is not intended to be limited by the specific disclosures of the embodiments herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used in conjunction with fastening building panel support profiles to substrates, and are described herein with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A building system comprising:

a weather resistant barrier disposed external to a building substrate;

at least one fiber cement wall cladding panel fixed to the weather resistant barrier and the building substrate such that the at least one fiber cement wall cladding panel is external to the weather resistant barrier and forms an exterior of the building system, the at least one fiber cement wall cladding panel comprising:

a substantially planar front face configured to face away from the weather resistant barrier and building substrate when the wall cladding panel is fixed thereto;

a rear face configured to face toward the weather resistant barrier and building substrate when the wall cladding panel is fixed thereto, the rear face comprising a plurality of integrally formed drainage channels arranged in a plurality of groups of adjacent drainage channels, the plurality of groups of adjacent drainage channels separated by one or more spacer sections, wherein each of the drainage channels comprises a curved channel surface having a c-shaped cross-section; and an edge member disposed contiguously between the front face and the rear face, wherein each of the plurality of integrally formed drainage channels has a depth that is between approximately 8% and approximately 60% of a thickness of the edge member; and a plurality of air gaps, each air gap being bounded by a portion of the weather resistant barrier and one of the drainage channels of the rear face, wherein each air gap comprises a liquid flow path.

2. The building system of claim 1, wherein the drainage channels comprise between approximately 18% and approximately 75% of a total surface area of the rear face.

3. The building system of claim 1, wherein each air gap comprises a liquid flow path between the weather resistant barrier and the wall cladding panel.

4. The building system of claim 1, wherein each drainage channel has a width of between approximately 0.5 mm (0.019 inches) and approximately 7.62 cm (3 inches).

5. The building system of claim 1, wherein each drainage channel has a depth of between approximately 0.6 mm (0.023 inches) and approximately 5 mm (0.19 inches).

6. The building system of claim 1, wherein the wall cladding panel includes between 8 and 16 drainage channels per lineal foot along a width of the wall cladding panel.

7. The building system of claim 1, wherein the wall cladding panel includes between 5 and 7 drainage channels per lineal foot along a width of the wall cladding panel.

8. The building system of claim 1, wherein the plurality of drainage channels are substantially parallel and are oriented vertically relative to ground level.

9. The building system of claim 1, wherein the at least one fiber cement wall cladding panel comprises a plurality of fiber cement wall cladding panels defining a wall section, each wall cladding panel being fixed to the weather resistant barrier and the building substrate.

10. The building system of claim 1, wherein the at least one fiber cement wall cladding panel is fixed to the weather resistant barrier and the building substrate by one or more mechanical fasteners, each of the one or more mechanical fasteners extending through one of the one or more spacer sections of the rear face, the weather resistant barrier, and at least a portion of the building substrate.

11. The building system of claim 1, wherein each of the one or more spacer sections is substantially parallel with the front face of the wall cladding panel.

12. A wall cladding panel comprising:

a fiber cement substrate having a substantially planar front face, a rear face, and an edge member disposed contiguously between the front face and the rear face;

the rear face comprising a plurality of substantially parallel drainage channels arranged in one or more groups of adjacent drainage channels, the one or more groups of adjacent drainage channels positioned adjacent to one or more spacer sections, each of the plurality of substantially parallel drainage channels comprising a curved channel surface, wherein the wall cladding panel has a first thickness at the one or more spacer sections and a second thickness at the drainage channels, and wherein the second thickness of the wall cladding panel at the drainage channels is between approximately 8% and approximately 60% of the first thickness of the wall cladding panel at the spacer sections; and wherein each drainage channel is configured to form a liquid flow path when a substantially planar building surface is placed adjacent to the rear face, and wherein the front face is configured to face away from the substantially planar building surface when the building surface is placed adjacent to the rear face of the wall cladding panel.

13. The wall cladding panel of claim 12, wherein the drainage channels comprise between approximately 18% and approximately 75% of a total surface area of the rear face.

14. The wall cladding panel of claim 12, wherein each drainage channel has a width of between approximately 0.5 mm (0.019 inches) and approximately 7.62 cm (3 inches).

15. The wall cladding panel of claim 14, wherein the wall cladding panel includes between 5 and 7 drainage channels per lineal foot along a width of the wall cladding panel.

16. The wall cladding panel of claim 14, wherein each drainage channel has a depth of between approximately 0.6 mm (0.023 inches) and approximately 5 mm (0.19 inches).

17. The wall cladding panel of claim 12, wherein the wall cladding panel includes between 8 and 16 drainage channels per lineal foot along a width of the wall cladding panel.

18. The wall cladding panel of claim 12, wherein each of the one or more spacer sections is substantially parallel with the front face of the wall cladding panel.

19. The wall cladding panel of claim 12, wherein the curved channel surface comprises a c-shaped cross-section.

20. The wall cladding panel of claim 19, wherein the c-shaped cross-section comprises a first end and a second end, the first end joining with an end of a first adjacent drainage channel and the second end joining with an end of a second adjacent drainage channel.

21. A method of mounting a wall cladding panel to a building substrate having a weather resistant barrier mounted thereon, the method comprising:

obtaining a first wall cladding panel made of fiber cement, the first fiber cement wall cladding panel comprising:

a substantially planar front face;

a rear face comprising a plurality of substantially parallel drainage channels arranged in one or more groups of adjacent drainage channels, the one or more groups of drainage channels positioned adjacent to one or more spacer sections, wherein each of the plurality of substantially parallel drainage channels comprises a curved channel surface; and an edge member disposed contiguously between the front face and the rear face, wherein each drainage channel is configured to form a liquid flow path when a substantially planar building surface is placed adjacent to the rear face, and wherein each of the plurality of drainage channels has a depth that is between approximately 8% and approximately 60% of a thickness of the edge member;

placing the first fiber cement wall cladding panel adjacent to the building substrate such that the rear face is parallel to and abutting the weather resistant barrier; and fixing the first fiber cement wall cladding panel through the weather resistant barrier to the building substrate to form a plurality of liquid flow paths, each liquid flow path comprising an air gap bounded by a portion of the weather resistant barrier and one of the drainage channels of the rear face.

22. The method of claim 21, wherein fixing the first fiber cement wall cladding panel through the weather resistant barrier to the building substrate comprises driving one or more mechanical fasteners through the front face, one of the one or more spacer sections of the rear face, the weather resistant barrier, and at least a portion of the building substrate.

23. The method of claim 22, wherein the method further comprises fixing a second fiber cement wall cladding panel through the weather resistant barrier to the building substrate to form a plurality of liquid flow paths, the second fiber cement wall cladding panel comprising a substantially planar front face and a rear face comprising a plurality of substantially parallel drainage channels, wherein the second fiber cement wall cladding panel is disposed adjacent to and either above or below the first fiber cement wall cladding panel, and at least one of the plurality of liquid flow paths formed by the second fiber cement wall cladding panel is contiguous with one of the plurality of liquid flow paths formed by the first fiber cement wall cladding panel.

* * * * *